United States Patent [19]

Tornay

[11] Patent Number: 4,964,437

[45] Date of Patent: Oct. 23, 1990

[54] APPARATUS AND METHOD FOR CONTROL OF OIL LEAKAGE FROM DAMAGED TANKER

[75] Inventor: Edmund G. Tornay, New York, N.Y.

[73] Assignee: Energy Transportation Group, Inc., New York, N.Y.

[21] Appl. No.: 451,103

[22] Filed: Dec. 15, 1989

[51] Int. Cl.[5] ..... B63B 25/08

[52] U.S. Cl. ..... 137/1; 137/899.2; 137/263; 137/395; 114/74 R; 114/125

[58] Field of Search ..... 114/74 R, 121, 124, 114/125; 137/899.2, 263, 386, 395, 1

[56] References Cited

U.S. PATENT DOCUMENTS

| | | | |
|---|---|---|---|
| 1,263,679 | 4/1918 | Kibele | 114/74 R |
| 1,888,667 | 11/1932 | Hort | 114/125 |
| 3,334,608 | 8/1967 | Nemoto et al. | 114/74 R |
| 3,745,960 | 7/1973 | Devine | 114/74 R |
| 3,812,807 | 5/1974 | Ando | 114/74 R |
| 3,832,966 | 9/1974 | Garcia | 114/74 R |
| 3,906,880 | 9/1975 | Herbert | 114/74 R |
| 3,916,811 | 11/1975 | Fromnick et al. | 114/74 R |
| 4,313,390 | 2/1982 | Yunoki et al. | 114/74 R |
| 4,549,267 | 10/1985 | Drabouski, Jr. | 114/124 |

*Primary Examiner*—A. Michael Chambers

*Attorney, Agent, or Firm*—Brumbaugh, Graves, Donohue & Raymond

[57] ABSTRACT

Outflow of oil from a damaged tanker of "segregated ballast" type having some tanks dedicated for carriage of oil and others for water ballast is minimized by transferring oil out of the upper part of any damaged tank and minimizing the reduction of draft at the damaged area. This is accomplished by installing sluice valves and piping to connect each cargo tank to one or more ballast tanks and providing controls therefor which, in case there is leakage from a cargo tank, are operative to open appropriate valves to allow oil to flow from the upper part of the damaged cargo tank to one or more ballast tanks, which would be empty.

7 Claims, 2 Drawing Sheets

APPARATUS AND METHOD FOR CONTROL OF OIL LEAKAGE FROM DAMAGED TANKER

BACKGROUND OF THE INVENTION

This invention relates generally to tankers for carriage of liquids such as oil and, more particularly, to apparatus for control of cargo leakage from a damaged tanker.

Internationally standardized regulations require that oil tankers greater than 20,000 tons deadweight be subdivided by longitudinal and transverse bulkheads arranged to form a plurality of tanks, some dedicated for carriage of cargo oil and some for sea water ballast. This arrangement is known as "segregated ballast" and replaces the previous practice of using tanks interchangeably for cargo oil and ballast, which frequently resulted in residual cargo oil being discharged overboard with ballast water.

In the event a fully loaded tanker of the "segregated ballast" type sustains damage by grounding or collision severe enough to rupture one or more of its cargo tanks, oil will flow out of the hull until the pressure of oil at the penetration is equal to the water pressure. Depending on the density of the oil relative to the density of the water, outflow usually stops when the oil level in the tank drops to just above the water level. As oil flows out from the damaged tank or tanks, the weight of the ship is reduced causing it to rise higher out of the water, and also heel and trim, thereby to reduce the draft at the area of damage, which further increases outflow of oil.

It is a primary object of the present invention to minimize the oil outflow from a damaged tanker of the "segregated ballast" type.

SUMMARY OF THE INVENTION

Briefly, the outflow of cargo from a damaged tanker is minimized, according to the invention, by transferring liquid cargo out of the upper part of any damaged cargo tank and, at the same time, keeping the reduction of draft at the damaged area to a minimum. This is accomplished by installing valves and piping though selected bulkheads to connect each cargo tank to one or more ballast tanks and providing instrumentation and controls responsive to the occurrence of damage sufficient to cause cargo tank leakage for opening one or more valves to allow oil to flow, by gravity, from the upper part of the damaged cargo tank or tanks to one or more ballast tanks which, if the tanker were fully loaded, would be empty. Although some liquid will go overboard, the amount will be reduced by the predictable and substantial flow to the ballast tank, the relative amounts lost overboard and transferred to the ballast tank or tanks depending on the relative sizes of the interconnecting piping and the opening in the hull. The flow through the interconnecting piping to the ballast tanks will be at a much higher velocity than the flow overboard because the driving head of pressure is the full height of the cargo above the connection through the bulkhead, whereas the driving head of the overboard leakage is the height of the oil in the cargo tank above the water line, the former being at least twice the latter.

Other objects, features and advantages of the invention, and a better understanding of its construction and operation, will be had from the following detailed description read in conjunction with the accompanying drawings.

DESCRIPTION OF THE PREFERRED EMBODIMENT

Figure 3:
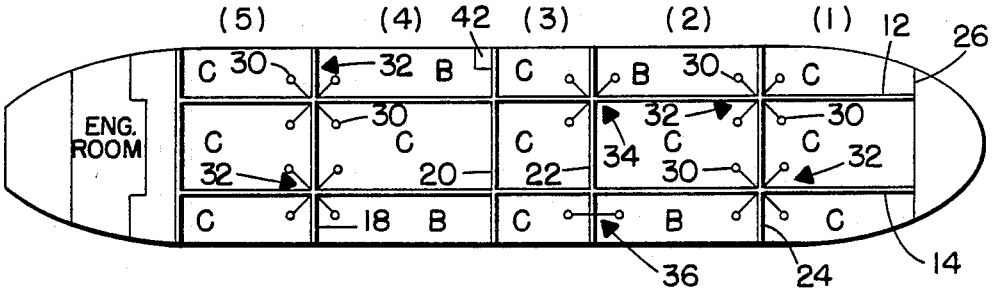
FIG. 3 is a diagrammatic plan view of the tanker.

FIGS. 114 3 diagrammatically illustrate an oil tanker 10 of the "segregated ballast" type which, as required by internationally standardized regulations, is subdivided by longitudinal bulkheads 12, 14 and transverse bulkheads 16, 18, 20, 22, 24, 26 to form a plurality of tanks, numbered (1) to (5) from bow to stern in FIG. 3, some of which are dedicated for carriage of cargo oil and others of which are dedicated for carriage of sea water ballast, designated "C" and "B", respectively. The longitudinal bulkheads 12 and 14 together with portions of the transverse bulkheads define five center cargo oil tanks, and bulkheads 12 and 14 together with the hull and other portions of the transverse bulkheads define two sets of wing tanks alternately dedicated for cargo oil and ballast. While it is the intention of the aforementioned regulations that the ballast tanks be used only for sea water ballast, in the practice of the present invention they are used as a receptacle for cargo oil in the event one or more cargo tanks are damaged, such use being justified on the grounds that containment is preferable to outflow of oil, and that the ballast tanks can, in any case, be cleaned.

Figure 4A:
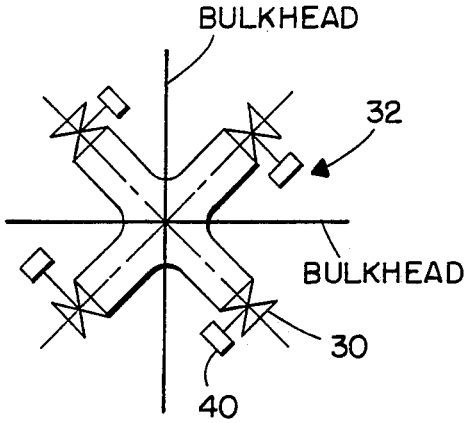
FIGS. 4A, 4B and 4C are symbolic diagrams of three different pipe fittings.

When the tanker is fully loaded all of the cargo tanks "CO" are filled almost to the top and the ballast tanks are all empty or nearly empty. In order to minimize oil outflow in the event one or more cargo tanks is ruptured by grounding or collision, valves and associated piping are installed on the bulkheads to connect each cargo tank to one or more ballast tanks. As shown in FIG. 3, paired sluice valves 30 with a connecting pipe or fitting are installed in selected bulkheads shared by a cargo tank and a ballast tank. The selection of ballast tanks to be connected to each cargo tank would depend on the number and arrangement of the tanks on the ship. In this exemplary arrangement, a pipe fitting 32 known as a "cross" and symbolically illustrated in FIG. 4A is installed through a bulkhead opening at each of four locations: at the intersections of longitudinal bulkhead 12 with transverse bulkheads 18 and 24, and the intersections of longitudinal bulkhead 14 with these same transverse bulkheads. Each arm of the fitting includes a respective valve 30 and actuator 40, the opening of any two of which with allow flow of liquid therethrough. At each of these four locations one arm of the "cross" is disposed in a ballast tank and each of the other three arms is disposed in a cargo tank.

Figure 4B:
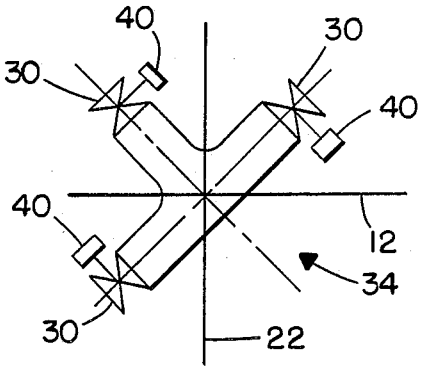
Figure 4C:
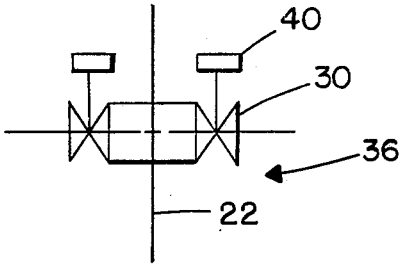

The center cargo tank and one of the wing cargo tanks of numbered tank (3) are connected to a wing ballast tank of numbered tank (2) with a "T" pipe fitting 34, of the type illustrated in FIG. 4B, installed in an opening located at the intersection of longitudinal bulkhead 12 with transverse bulkhead 22. The other wing cargo tank of numbered tank (3) is connected to the other wing ballast tank of numbered tank (2) with a fitting 36 of the kind illustrated in FIG. 4C installed in the transverse bulkhead 22 which separates them. Thus, each connection between a cargo tank and a ballast tank has two valves in series, as required by regulations, to prevent contamination of ballast due to minor valve leakage in normal operation. The valves are preferably of the butterfly type, mainly because of their relatively lower cost in large sizes and, typically, may have a diameter in the range between one foot and four feet; the choice of valve and piping size is a tradeoff between the cost of the valves and associated piping and the time it will take to transfer sufficient oil out of the upper part of any damaged tank into one or more ballast tanks to stop the flow of oil out of the hull. Each of the valves, of which there are twenty-one in the arrangement illustrated in FIG. 3, are installed on a bulkhead at a vertical height above the tanker's bottom corresponding approximately to the tanker's beam divided by 15 so as to have the benefit of the maximum head while minimizing the possibility of damage to the sluice valves due to the grounding. As shown in the diagram of FIG. 5, but not in FIG. 3 in the interest of clarity, each valve is equipped with a valve actuator 40 which is operative responsively to an applied control signal to quickly open (or close) its associated valve.

Figure 1:
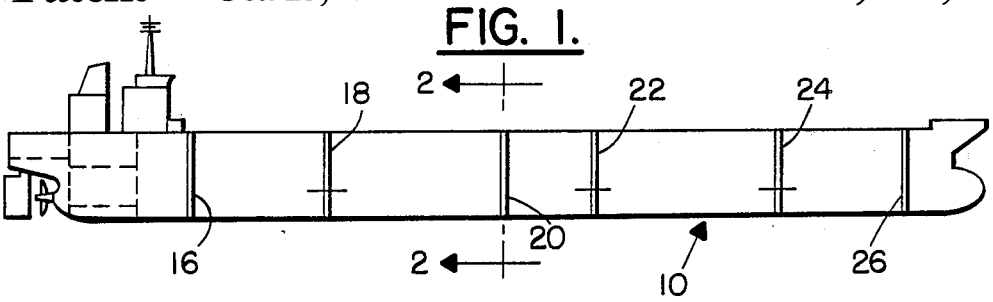
FIG. 1 is a diagrammatic elevation cross-sectional view of an oil tanker of the segregated ballast type.
Figure 2:
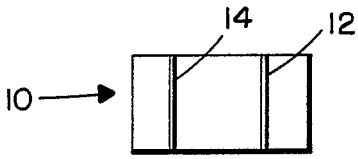
FIG. 2 is a midship section of the tanker, taken along line 2—2 in FIG. 1.
Figure 5:
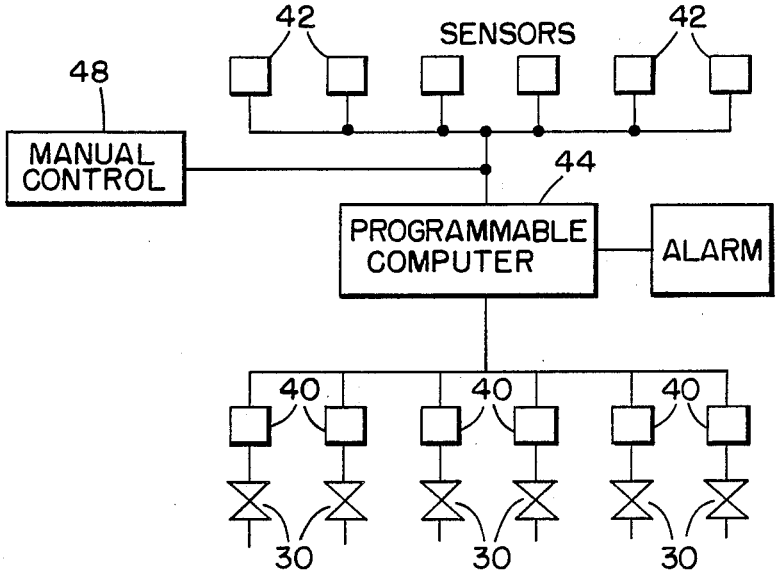
FIG. 5 is a schematic block diagram showing an instrumentation and control system for the system according to the invention.

A level sensor 42 responsive to changes in liquid level installed in each cargo tank, one of which is shown in FIG. 1 and six of which are shown in the schematic diagram of FIG. 5, detects a drop in oil level as would be caused by outflow of oil therefrom and in response generates and applies an output signal to a programmable computer 44. Upon receipt of a signal from one or more sensor, the computer sounds an alarm 46 and applies a control signal to each of the valve actuators 40 appropriate to open the sluice valves that will minimize oil outflow. The computer 44 is preprogrammed to open the appropriate sluice valves so as to redistribute the cargo to minimize overboard leakage and at the same time control trim, heel, sinkage and stability of the vessel within safe limits. The instrumentation preferably includes an override control 48 and display panel (not shown) mounted on the bridge of the tanker for enabling manual operation of the valves 30 should conditions require.

In operation, in the event a fully loaded tanker sustains damage severe enough that oil flows out of the hull, the sensor 42 in the affected cargo tank or tanks transmits an output signal to the computer 44 which, in turn, causes appropriate valves to automatically open to allow oil to flow from the upper part of the damaged cargo tank or tanks to a selected ballast tank or tanks, which would be empty. Although some oil will continue to go overboard, the amount will be reduced by the substantial flow of oil to the ballast tank or tanks, the volume of which and, accordingly, the time required to drop the oil level in the damaged tank to just above the water level, are predictable. By containing the oil which would otherwise be discharged overboard the weight of the vessel is not significantly reduced; that is to say, because the outflow is reduced the ship does not rise out of the water and the draft at the area of damage is substantially maintained which, in itself, contributes to a decrease in the oil outflow. The relative amounts lost overboard and sluiced to the ballast tank or tanks depends on the relative sizes of the sluice line and the rupture in the cargo tank or tanks. The flow of oil through the sluice line to the ballast tanks will be at a much higher velocity than the flow overboard because the pressure head is the height of the cargo above the sluice valve, whereas the driving head of the overboard leakage is the height of the cargo above the water line.

As has been indicated previously, no pumps are required for the transfer of oil from cargo tank to ballast tank; the transfer is accomplished entirely by gravity with assistance from the phenomenon that oil flow out of the hull ceases when the oil level in a ruptured tank drops to just above the water level.

While a preferred embodiment of the invention has been described, it will be evident that various changes and modifications may be effected without departing from the spirit and scope of the inventive concept. It is to be understood that the invention is not limited to the specific embodiment illustrated here, the intention being to cover by the appended claims all such modifications as fall within their scope.

I claim:

1. Method for controlling leakage of oil from a damaged tanker of the type that is divided by longitudinal and transverse vertically-oriented bulkheads arranged to form a plurality of tanks, some dedicated for carriage of oil and others dedicated for carriage of water ballast and empty when the tanker is fully loaded, comprising the steps of:

connecting normally closed conduits from each cargo tank to at least one ballast tank through a common bulkhead at an elevation below the oil level of a fully loaded tanker and a selected height above the bottom of the tanker;

sensing a rupture in an oil cargo tank and in response generating an indicating signal, in response to an indicating signal opening one or more of the conduits connected to an oil cargo tank determined to be ruptured and transferring oil out of the upper part thereof by gravity flow to one or more empty ballast tanks, and redistributing the tanker's oil cargo to minimize outflow of oil form the rupture and to control within safe limits the tanker's trim, heel, sinkage and stability.

2. Apparatus for minimizing outflow of liquid from a rupture in a cargo tank of a tanker of the type that is subdivided by longitudinal and transverse vertically-oriented bulkheads arranged to form a plurality of tanks, some dedicated for the carriage of liquid cargo and others dedicated for carriage of water ballast and empty when the tanker is fully loaded with liquid cargo, said apparatus comprising:

means including normally closed valve means fitted in each bulkhead that is common to a cargo tank and to a ballast tank at an elevation below the liquid cargo level of a fully loaded tanker and a predetermined height above the bottom of the tanker and when opened providing a connection for liquid cargo to flow from its associated cargo tank by gravity to an empty ballast tank, sensing means in each cargo tank for detecting the occurrence of a rupture therein sufficient to cause outflow of liquid cargo and responsively thereto producing an output signal, and control means responsive to said output signal for opening the valve means fitted in a bulkhead of a cargo tank detected by said sensing means as having been ruptured and providing a connection for liquid cargo to flow from the ruptured cargo tank by gravity to a ballast tank at a rate proportional to the difference in elevation between the level of the liquid cargo and said valve means.

3. Apparatus according to claim 2, wherein each bulkhead common to a cargo tank and a ballast tank has valve means fitted therein at a vertical height above the bottom of the tanker substantially corresponding to the tanker's beam divided by 15.

4. Apparatus according to claim 3, wherein each said valve means comprises a pair of butterfly valves connected in series.

5. Apparatus according to claim 2, wherein said control means includes programmable computer means responsive to output signals from said sensing means for opening those valve means appropriate for redistributing the liquid cargo of the tanker to minimize outflow of liquid and at the same time controlling within safe limits the tanker's trim, heel, sinkage and stability

6. Apparatus according to claim 5, wherein said control means includes means responsive to said computer for sounding an alarm to indicate that the tanker has been damaged.

7. Apparatus for controlling leakage of oil form a damaged tanker of the type that is divided by longitudinal and transverse vertically-oriented bulkheads arranged to form a plurality of tanks, some dedicated for carriage of oil and others dedicated for carriage of water ballast and empty when the tanker is fully loaded with oil, said apparatus comprising:

means for providing a connection from each cargo tank to at least one ballast tank through a common bulkhead at an elevation below the oil level of a fully loaded tanker and a vertical height above the bottom of the tanker corresponding to about the tanker's beam divided by 15, each said means including normally closed sluice valve means fitted in a bulkhead for providing when opened a conduit for oil to flow from the upper part of a cargo tank by gravity to a ballast tank;

sensing means disposed in each cargo tank for sensing a drop in level of therein contained oil as may be caused by outflow of oil from a rupture in the tank and in response generating an indicating signal; and control means including programmable computer means pre-programmed to respond to indicating signals for opening valve means as appropriate for providing one or more conduits for oil to flow from the part of a ruptured cargo tank that is above said valve means by gravity to one or more ballast tanks and redistributing the cargo for minimizing outflow of oil and for controlling within safe limits the tanker's trim, heel, sinkage and stability.

* * * * *